US006820957B2

(12) United States Patent
Aihara

(10) Patent No.: US 6,820,957 B2
(45) Date of Patent: Nov. 23, 2004

(54) PRINTHEAD, PRINTING APPARATUS COMPRISING SAID PRINTHEAD, AND PRINT CONTROL METHOD THEREOF

(75) Inventor: Yoshihiko Aihara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/437,910

(22) Filed: May 15, 2003

(65) Prior Publication Data

US 2003/0214544 A1 Nov. 20, 2003

(30) Foreign Application Priority Data

May 17, 2002 (JP) ..... 2002-143419

(51) Int. Cl.[7] ..... B41J 29/38
(52) U.S. Cl. ..... 347/12
(58) Field of Search ..... 347/12, 9, 5, 20, 347/10, 14, 11, 141, 142, 143, 144, 237, 56–61; 377/94, 111, 118

(56) References Cited

U.S. PATENT DOCUMENTS 4,313,124 A 1/1982 Hara
4,345,262 A 8/1982 Shirato et al.
4,459,600 A 7/1984 Sato et al.
4,463,359 A 7/1984 Ayata et al.
4,558,333 A 12/1985 Sugitani et al.
4,723,129 A 2/1988 Endo et al.
4,740,796 A 4/1988 Endo et al.
5,253,934 A * 10/1993 Potucek et al. ..... 347/237
2001/0045967 A1 11/2001 Hayasaki

FOREIGN PATENT DOCUMENTS

JP 59-123670 7/1984
JP 59-138461 8/1984

* cited by examiner

*Primary Examiner*—Raquel Yvette Gordon
(74) *Attorney, Agent, or Firm*—Fitzpatrick, Cella, Harper & Scinto

(57) ABSTRACT

The present invention relates to a printhead, a printing apparatus comprising the printhead, and a print control method thereof. The printhead includes a plurality of heating elements and a driving circuit for electrifying and driving the heating elements. The printhead comprises: a shift register for serially inputting digital data, supplied from an external unit, and retaining the data; a counter for counting a clock; a comparator for comparing time-length data, included in the digital data, with a counted value of the counter, and outputting a match signal when a match is found; and a flip-flop circuit for enabling a driving signal in response to a driving start signal supplied from an external unit, and disenabling the driving signal in response to the match signal outputted based on the counted value of the counter from the driving start signal.

12 Claims, 8 Drawing Sheets

PRINTHEAD, PRINTING APPARATUS COMPRISING SAID PRINTHEAD, AND PRINT CONTROL METHOD THEREOF

FIELD OF THE INVENTION

The present invention relates to a printhead, a printing apparatus comprising said printhead, and a print control method thereof.

BACKGROUND OF THE INVENTION

An ink-jet printing apparatus which forms an image on a printing medium, e.g., paper, is configured with a printhead, which is mounted on a carriage that scans in a main-scanning direction and discharges ink, and conveys the printing medium by conveyance means. In the image forming operation, in synchronization with the printhead's scanning operation in the main-scanning direction, the printhead discharges ink, thereby performing a printing operation. Thereafter, the printing medium is conveyed for a predetermined distance in a sub-scanning direction. Printing is performed by repeatedly executing the foregoing operation. The printhead of this type includes a plurality of nozzles. When the printhead is scanned in the main-scanning direction, ink is selectively discharged from respective nozzles, thereby printing an image.

In image printing, in a case where a large number of nozzles are simultaneously driven for ink discharge, a current that flows through the printhead is higher compared to a case where a small number of nozzles are simultaneously driven. Therefore, when a large number of nozzles are simultaneously driven for ink discharge, a voltage applied to the printhead drops due to the influence of contact resistances and wire resistances or the like. When such voltage drop occurs, heating elements (heaters) of the nozzles are not sufficiently heated, thus causing insufficient ink evaporation. As a result, it causes a problem in that ink is not appropriately discharged from respective nozzles.

In order to overcome such problem, the following measure may be considered. In a case where the number of nozzles simultaneously driven for ink discharge is large, the heating time-length for applying a voltage to electric resistances of the heating elements is set sufficiently long so that required electric energy is always supplied to the heating elements. In other words, conventional general ink-jet printers overcome the above-described problem by setting a longer heating time-length in a case where the number of nozzles simultaneously driven is large, and setting a shorter heating time-length in a case where the number of nozzles simultaneously driven is small.

In order to determine whether the number of nozzles simultaneously driven is large or small, the number of nozzles to be driven must be detected in advance of heating the heating elements, and the heating time-length must be calculated based on the number of nozzles to be driven. Such advance calculation function of the heating time-length is generally provided in an internal unit of a gate array circuit which generates print data to be sent to the printhead. In other words, at the time of sending print data to the printhead, the gate array circuit calculates the heating time in accordance with the print data and the number of nozzles to be driven simultaneously, and at the time of actual heating, the gate array circuit outputs a pulse signal having a pulsewidth corresponding to the calculated heating time (hereinafter referred to as a heat pulse) to the printhead, thereby controlling the ink discharge.

However, if a waveform of the heat pulse is distorted while the heat pulse is transmitted from the gate array circuit to the printhead mounted to the carriage, the above-described control of heating time cannot be accurately performed. In general, a gate array circuit is mounted to a control substrate fixed to the printer main unit. From the output pin of the substrate to the input pin of the printhead mounted on the carriage, the heat pulse must go through at least three connectors and at least one flexible cable. If an influence of contact resistances and wire resistances of the connectors or cables and an electric capacity of wires causes distortions in a rising edge or a trailing edge of the waveform of the heat pulse, accurate control of the heating time cannot be achieved.

SUMMARY OF THE INVENTION

The present invention has been proposed in view of the above conventional art, and has as its feature to provide a printhead which stores data related to a printhead's driving time-length in an internal portion of the printhead so that respective printing elements of the printhead can be driven based on the data, and to provide a printing apparatus comprising said printhead, as well as a print control method thereof.

Another feature of the present invention is to provide a printhead which stores data related to a printhead's driving time-length so that mere supplying of a driving start signal from an external unit of the printhead can realize driving of the printhead corresponding to the driving time-length, and to provide a printing apparatus comprising said printhead, as well as a print control method thereof.

Another feature of the present invention is to provide a recording head for recording by driving heating elements in accordance with recording data, comprising: a shift register adopted to serially receive the recording data and a signal for designating a time period of driving the heating elements via a signal line from a main body of an ink-jet apparatus; and recording means for recording using the recording data stored in the shift register and the signal for designating the time period of driving the heating elements.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings. Note that although the following embodiments describe as an example an ink-jet printing apparatus employing heating resistance elements, the present invention is not limited to this. The present invention is also applicable to, e.g., a thermal printer employing a thermal printhead, or printers employing other methods.

[First Embodiment]

Figure 1:
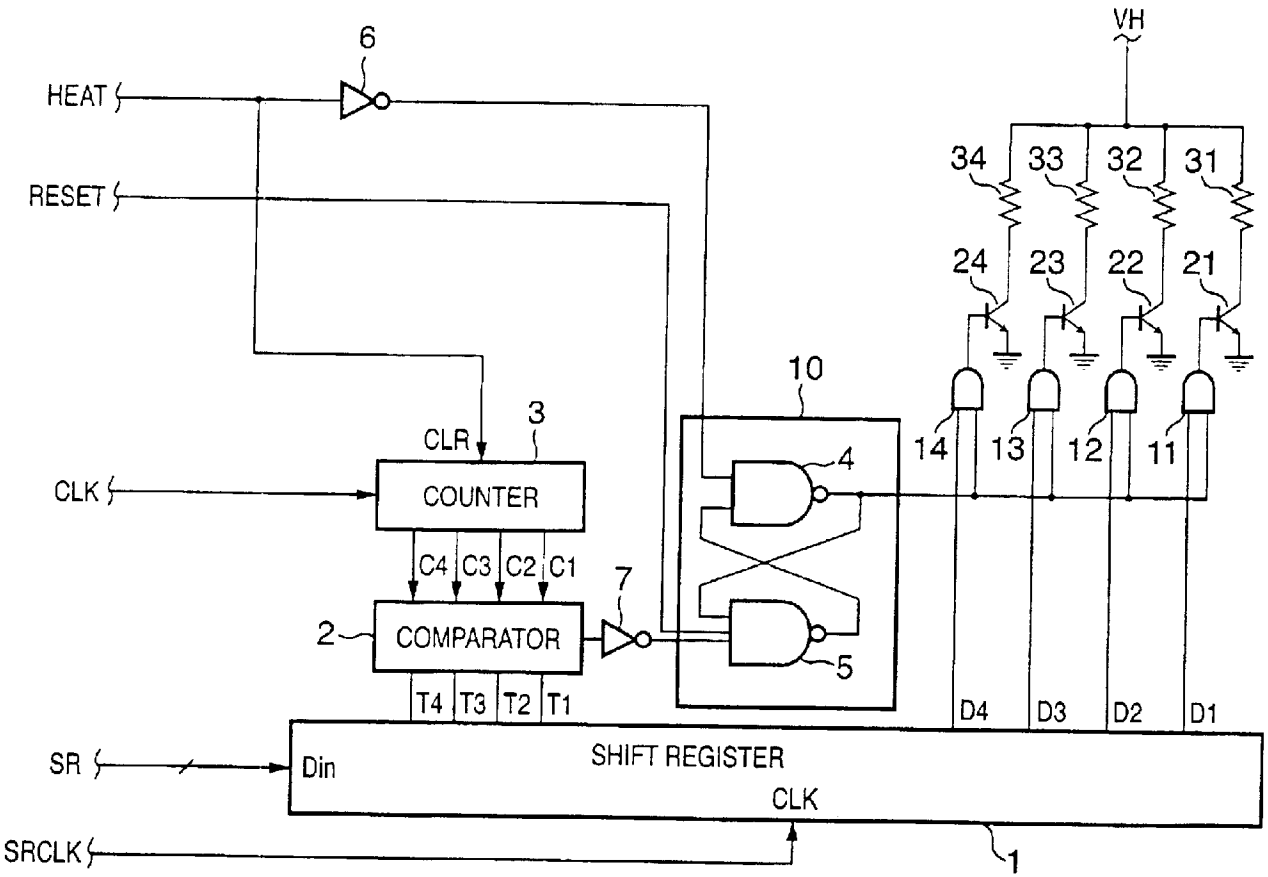
FIG. 1 depicts a block diagram showing a configuration of an ink-jet printhead unit according to the first embodiment of the present invention.

FIG. 1 shows an electric circuit of a printhead unit for an ink-jet printing apparatus according to the first embodiment of the present invention.

In an 8-bit shift register 1 in FIG. 1, 1-bit data as an SR signal is serially inputted, and the data (SR) is shifted in synchronization with an SRCLK signal serving as a shift clock for shifting the data. The data (SR) and shift clock (SRCLK) are inputted from an external unit of the printhead. The shift register 1 serially retains 8 bits of data. Among these 8 bits, the first inputted 4 bits (D1, D2, D3, D4) are print data representing an image to be actually printed. The latter inputted 4 bits (T1, T2, T3, T4) are data representing a heating time-length. Numeral 2 denotes a comparator which performs data comparison among the 4 bits. Numeral 3 denotes a counter. A clock signal CLK is always inputted to the counter 3 from an external unit of the printhead. 4-bit signals (C1, C2, C3, C4) outputted as a binary signal from the counter 3 are counted up in synchronization with a rising edge of the clock signal (CLK). After all the signals (C1, C2, C3, C4) become 1, all of them (C1, C2, C3, C4) return to 0 at the next rising edge of the clock signal (CLK), and the count-up operation continues. For the purpose to compulsorily return all the count values to 0 in the initial state, a heating start timing signal HEAT is applied to a clear input terminal (CLR) of the counter 3. By this, the counter 3 is reset to 0 when the heating starts (when the heating start timing signal HEAT becomes a high level).

The comparator 2 compares the data (T1, T2, T3, T4) indicative of the heating time-length, which is outputted from the shift register 1, with the counted value (C1, C2, C3, C4) of the counter 3, and outputs a high-level signal when a match is found. Numerals 4 and 5 respectively denote 2-input and 3-input NAND gates, which constitute a flip-flop 10. To one end of the input terminals of the NAND gate 4, the heating start timing signal HEAT is applied from an external unit of the printhead through the inverter 6, and to the other end of the NAND gate 4, an output of the NAND gate 5 is inputted. To the first input terminal of the NAND gate 5, an output of the NAND gate 4 is inputted. To the second input terminal of the NAND gate 5, a reset input signal RESET is applied to set the flip-flop circuit to an initial state. By this configuration, the flip-flop 10 is set at the start of heating, and the NAND gate 4 outputs a high-level signal. When the comparator 2 outputs a match signal (after the heating time-length has elapsed), the flip-flop 10 is reset and the NAND gate 4 outputs a low-level signal.

Numerals 11, 12, 13, and 14 denote AND gates. To each one end of respective input terminals of the AND gates 11 to 14, print data (D1, D2, D3, D4) from the shift register 1 is respectively inputted. To the other end of the AND gates 11 to 14, an output signal of the NAND gate 4 (an output of the flip-flop 10) is applied. Numerals 21, 22, 23, and 24 denote NPN-type switching transistors. To each base of the transistors 21 to 24, an output signal of the corresponding AND gates 11 to 14 is inputted. Respective emitters of the transistors 21 to 24 are grounded, and respective collectors are connected to resistors 31, 32, 33, and 34 serving as heating elements for discharging ink from respective nozzles. The other ends of the resistors 31 to 34 are connected to a VH which serves as a power-supply voltage for driving the printhead. The transistors 21 to 24 switch the state of respective resistors 31 to 34 between a current-flowing state and a non-flowing state in accordance with respective outputs of the AND gates 11 to 14.

Next, an operation of the electric circuit shown in FIG. 1 is described.

When the power of the electric circuit of the printhead shown in FIG. 1 is turned on, the RESET signal temporarily becomes low. Although not specified, the RESET signal may be generated by an external unit of the printhead (printer main unit), or a power-on reset device or circuit included in the printhead.

The heating start timing signal HEAT outputs a low-level signal at normal times. By this, the flip-flop 10 constructed with the NAND gates 4 and 5 is reset, and the NAND gate 4 outputs a low-level signal. The output of the flip-flop 10, i.e., output signal of the NAND gate 4, is connected respectively to each end of the AND gates 11 to 14. Therefore, in an initial state, all the AND gates (11, 12, 13, 14) output a low-level signal. As a result, low-level signals are applied to all the bases of the transistors (21, 22, 23, 24), and the transistors are turned off. As a result, no current flows to the resistors (31, 32, 33, 34) and ink is not discharged.

Next, a circuit operation in a case of discharging ink is described.

When data (print data and time-length data subsequent to the print data) is supplied from the signal line SR to the shift register 1 along with the synchronization clock SRCLK, the data is stored in the shift register 1 in synchronization with the rising edge of the SRCLK.

Figure 2:
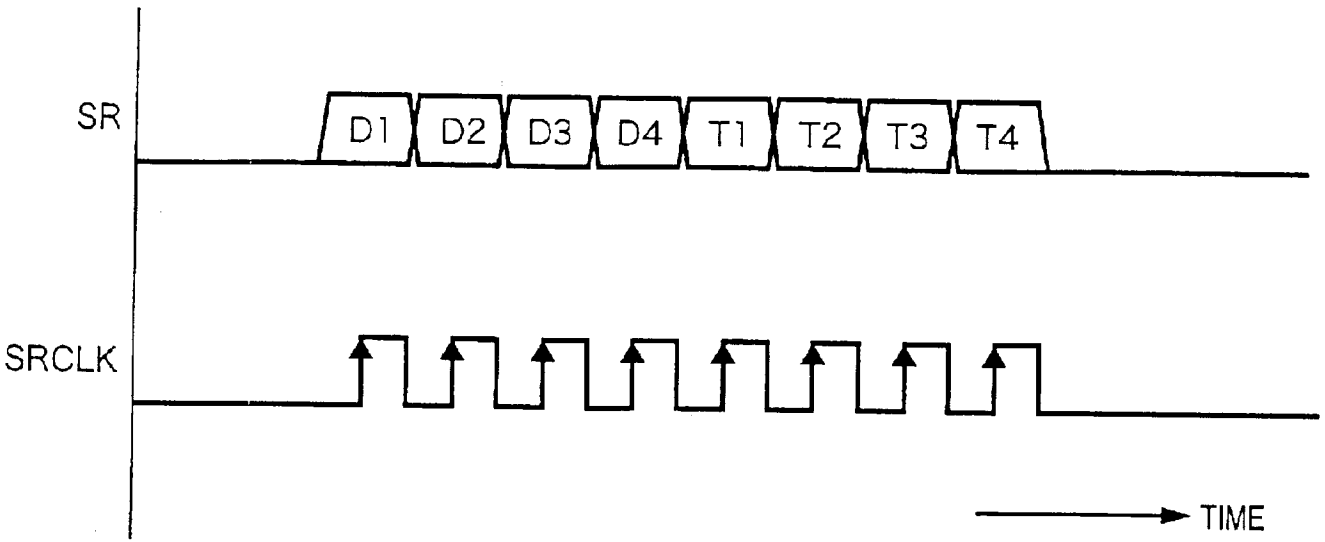
FIG. 2 depicts a timing chart describing a relation between a synchronization clock and data transfer to a shift register.

FIG. 2 is a timing chart describing a relation between a synchronization clock and 8-bit data storage in the shift register 1 according to the first embodiment. In FIG. 2, the axis indicates the progression of time in the direction from the left to right. The data (SR) is inputted to the shift register 1 in order of D1–D4 and T1–T4 in synchronization with the shift clock (SRCLK).

Subsequent to the print data (D1, D2, D3, D4), data designating the heating time-length (T1, T2, T3, T4) is transferred as digital data. The 8-bit data transfer is completed in the foregoing manner, and the 8-bit data is stored in the shift register 1. Thereafter, at print timing, the HEAT signal applied by an external unit of the printhead (printer main unit) is inverted by the inverter 6 and supplied as a low-level pulse signal. By this, the low-level signal is applied to an input of NAND gate 4, the flip-flop 10 is set, and respective AND gates 11 to 14 drive the corresponding transistors 21 to 24 to start heating the corresponding resistors 31 to 34 in accordance with the print data D1 to D4 supplied from the shift register 1.

Meanwhile, since the HEAT signal is inputted to a clear terminal (CLR) of the counter 3, output signals of the counter 3 (C1, C2, C3, C4) are cleared to 0 at this timing. At this stage, since the values of the heating time-length data (T1, T2, T3, T4) outputted from the shift register 1 are not all 0, the comparator 2 outputs a low-level signal indicative of a non-match. When the counter 3 counts up the signal in accordance with the clock signal CLK and the counted value becomes equal to the heating time-length data (T1, T2, T3, T4), the comparator 2 outputs a high-level signal indicative of a match. By this, the flip-flop 10 is reset, and the AND gates 11 to 14 output low-level signals. As a result, an electric supply to the resistors 31 to 34 stops.

As described above, until the counted value of the counter 3 becomes equal to the heating time-length data (T1, T2, T3, T4), in other words, during the time corresponding to the heating time-length data (T1, T2, T3, T4), ink evaporates and expands in the nozzle having the heated resistors, thereby discharging ink from the nozzle.

[Second Embodiment]

Figure 3:
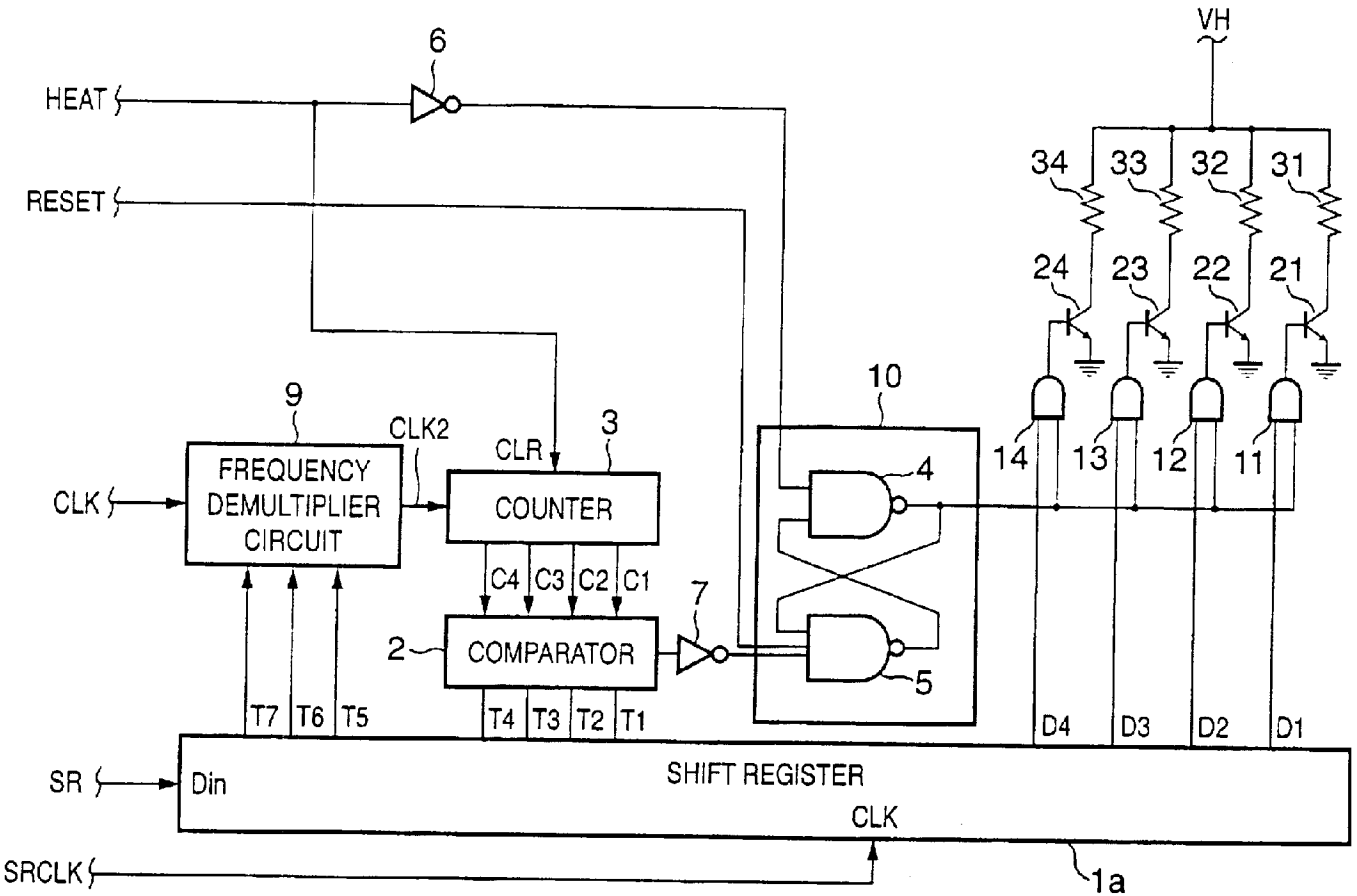
FIG. 3 is a block diagram showing a configuration of an ink-jet printhead unit according to the second embodiment of the present invention.

FIG. 3 shows an electric circuit of a printhead unit for an ink-jet printing apparatus according to the second embodiment of the present invention. For the components common to those of FIG. 1, the same reference numerals and symbols are assigned, and descriptions thereof are omitted.

Numeral 1*a* denotes an 11-bit shift register. The first inputted 4 bits are print data (D1, D2, D3, D4) as mentioned above, and the latter inputted 7 bits (T1, T2, T3, T4, T5, T6, T7) are digital data representing a heating time-length. Numeral 9 denotes a frequency de-multiplier circuit, which de-multiplies a clock signal CLK in accordance with 3-bit data (T5, T6, T7) outputted from the shift register 1*a*, and supplies the de-multiplied signal CLK2 to the counter 3. The circuit 9 can take eight de-multiplying rates: 2 de-multiplying, 4 de-multiplying, 8 de-multiplying, 16 de-multiplying, 32 de-multiplying, 64 de-multiplying, 128 de-multiplying, and 256 de-multiplying, in accordance with values (000) to (111) of the 3-bit data (T5, T6, T7). Therefore, the counter 3 performs counting based on the clock signal CLK2 de-multiplied by the circuit 9.

Next, an operation of the electric circuit shown in FIG. 3 is described.

When the power of the electric circuit of the printhead shown in FIG. 3 is turned on, the RESET signal temporarily becomes low. Although not specified, the RESET signal may be generated by an external unit of the printhead (printer main unit), or a power-on reset device or circuit included in the printhead.

The heating start timing signal HEAT outputs a low-level signal at normal times. By this, the flip-flop 10 constructed with the NAND gates 4 and 5 is reset, and the NAND gate 4 outputs a low-level signal. The output of the flip-flop 10, i.e., output signal of the NAND gate 4, is connected respectively to each end of the AND gates 11 to 14. Therefore, in an initial state, all the AND gates (11, 12, 13, 14) output a low-level signal. As a result, low-level signals are applied to all the bases of the transistors (21, 22, 23, 24), and the transistors are turned off. As a result, no current flows to the resistors (31, 32, 33, 34) and ink is not discharged.

Next, a circuit operation in a case of discharging ink is described.

When data is supplied from the signal line SR to the shift register 1*a* along with the synchronization clock SRCLK, the data is stored in the shift register 1*a* in synchronization with the rising edge of the SRCLK.

Subsequent to the print data (D1, D2, D3, D4), data designating the heating time-length (T1, T2, T3, T4) and data setting a de-multiplying value (T5, T6, T7) are transferred as digital data. The 11-bit data transfer is completed in the foregoing manner, and the 11-bit data is stored in the shift register 1*a*. Thereafter, at print timing, the HEAT signal applied by an external unit of the printhead (printer main unit) is inverted by the inverter 6 and supplied as a low-level pulse signal. By this, the flip-flop 10 is set, and respective AND gates 11 to 14 drive the corresponding transistors 21 to 24 to start heating the corresponding resistors 31 to 34 in accordance with the print data D1 to D4 supplied from the shift register 1*a*.

Meanwhile, since the HEAT signal is inputted to a clear terminal (CLR) of the counter 3, output signals of the counter 3 (C1, C2, C3, C4) are cleared to 0 at this timing. At this stage, since the values of the heating time-length data (T1, T2, T3, T4) outputted from the shift register 1*a* are not all 0, the comparator 2 outputs a low-level signal indicative of a non-match. When the counter 3 counts up the signal in accordance with the clock signal CLK2, which is de-multiplied by the frequency de-multiplying circuit 9 in accordance with the data (T5 to T7), and the counted value becomes equal to the heating time-length data (T1, T2, T3, T4), the comparator 2 outputs a high-level signal indicative of a match. By this, the flip-flop 10 is reset, and the AND gates 11 to 14 output low-level signals. As a result, an electric supply to the resistors 31 to 34 stops.

As described above, until the counted value of the counter 3 becomes equal to the heating time-length data (T1, T2, T3, T4), in other words, during the time corresponding to the heating time-length data (T1, T2, T3, T4), ink evaporates and expands in the nozzle having the heated resistors, thereby discharging ink from the nozzle.

Comparing FIG. 3 with FIG. 1, since the configuration shown in FIG. 3 comprises the frequency de-multiplier circuit 9, precision of the heating time-length can arbitrarily be set in accordance with the frequency (cycle) of the clock signal CLK. Therefore, more flexible control of the heat pulsewidth according to circumstances can be achieved.

Figure 4:
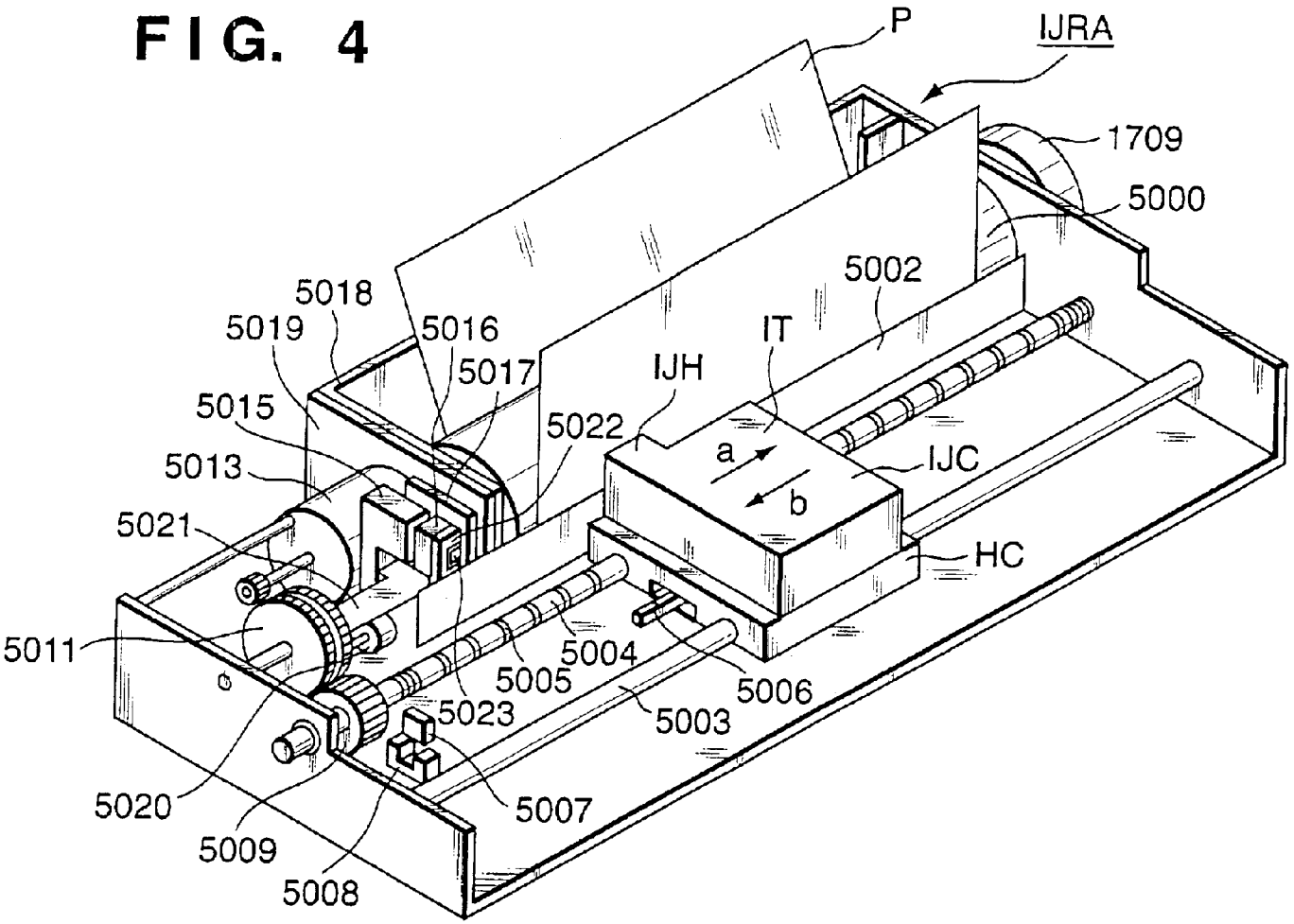
FIG. 4 depicts a perspective view showing a main construction of an ink-jet printing apparatus according to the embodiments of the present invention.

FIG. 4 shows an outer appearance of an ink-jet printing apparatus IJRA according to the embodiments (first and second embodiments) of the present invention. This ink-jet printing apparatus comprises an ink-jet printhead IJH described in the embodiments.

Referring to FIG. 4, a carriage HC engages with a spiral groove 5005 of a lead screw 5004, which rotates via driving force transmission gears 5011 and 5009 upon forward/reverse rotation of a driving motor 5013. The carriage HC has a pin (not shown), and is reciprocally scanned in the directions of arrows a and b in FIG. 4. An ink-jet cartridge (printhead) IJC is mounted on the carriage HC. Reference numeral 5002 denotes a paper pressing plate, which presses printing paper P serving as a printing medium against a platen 5000 from one end to the other end of the scanning path of the carriage HC. The platen 5000 is rotated by a conveyance motor 1709. Reference numerals 5007 and 5008 denote photocouplers which serve as a home position detector for recognizing the presence of a lever 5006 of the carriage in a corresponding region, and used for switching, e.g., the rotating direction of the motor 5013. Reference numeral 5016 denotes a member for supporting a cap member 5022, which caps the front surface of the printhead IJH; and 5015, a suction device for suctioning ink residue through the interior of the cap member. The suction device 5015 performs suction recovery of the printhead IJH via an opening 5023 of the cap member. Reference numeral 5017 denotes a cleaning blade; and 5019, a member which allows the blade 5017 to be movable in the back-and-forth directions of the blade. These members are supported by a main unit supporting plate 5018. The shape of the blade is not limited to this, but a known cleaning blade can be used in the embodiments. Reference numeral 5021 denotes a lever for initiating a suction operation in the suction recovery operation. The lever 5021 moves upon movement of a cam 5020, which engages with the carriage HC, and receives a driving force from the driving motor 5013 via a known transmission mechanism such as clutch switching.

The capping, cleaning, and suction recovery operations are performed at their corresponding positions upon operation of the lead screw 5004 when the carriage reaches the home-position side region. However, the present invention is not limited to this arrangement as long as desired operations are performed at known timings.

<Description of Control Structure>

Figure 5:
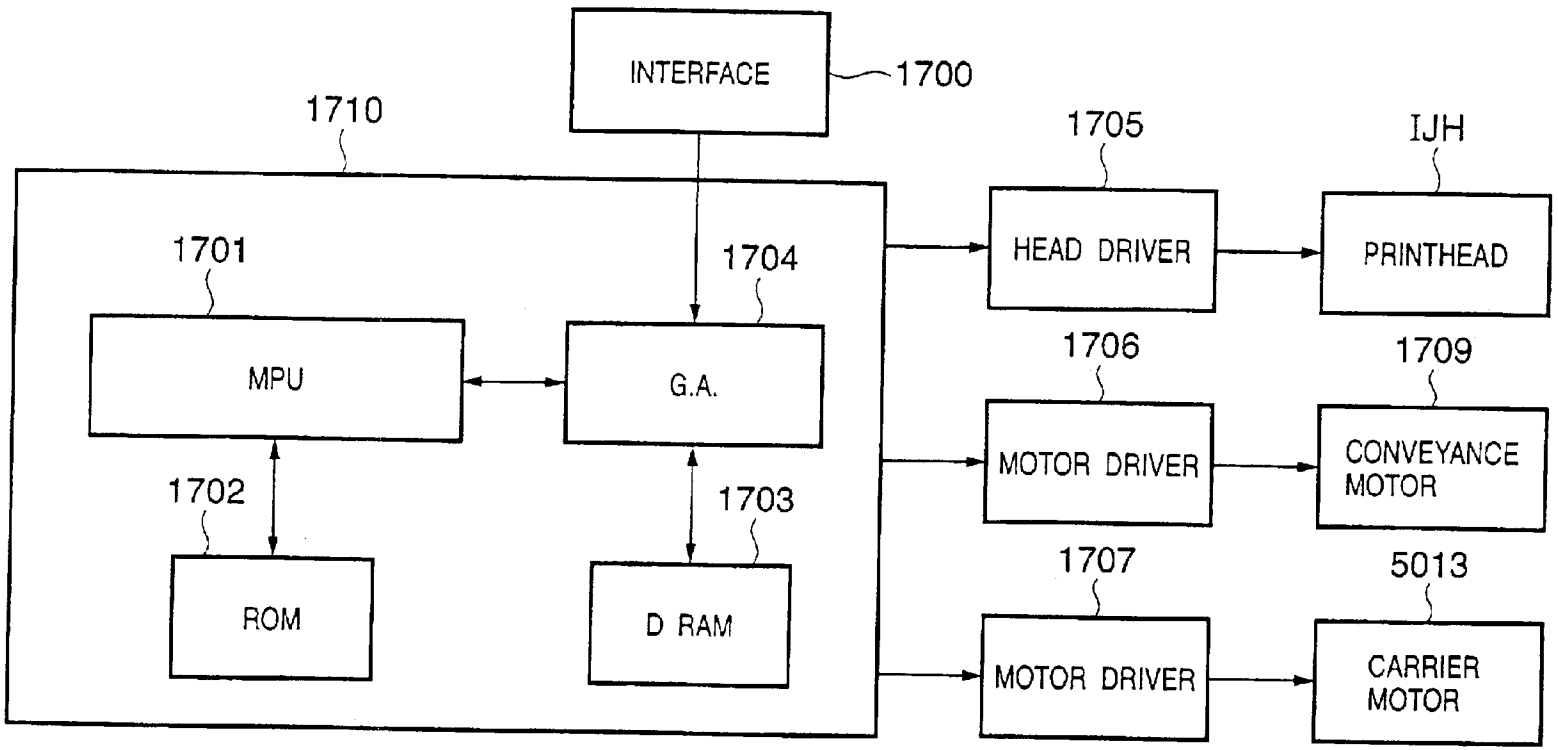
FIG. 5 is a block diagram showing a configuration of the ink-jet printing apparatus according to the embodiments of the present invention.

Next, a control structure for executing print control of the above-described apparatus is described with reference to the block diagram in FIG. 5. Referring to FIG. 5 showing the control circuit, reference numeral 1700 denotes an interface for inputting a print signal from an external unit (not shown); 1701, an MPU; 1702, a programmable ROM for storing a control program executed by the MPU 1701; and 1703, a DRAM for storing various data (the aforementioned print signal, print data supplied to the printhead, and the like). Reference numeral 1704 denotes a gate array for performing supply control of print data to the printhead IJH. The gate array 1704 also performs data transfer control among the interface 1700, the MPU 1701, and the RAM 1703. A control unit 1710 includes the MPU 1701, RAM 1703, ROM 1702, and gate array 1704. Reference numeral 5013 denotes a carrier motor for carrying the printhead IJH; and 1709, a conveyance motor for conveying a printing sheet. Reference numeral 1705 denotes a head driver for driving a head; and 1706 and 1707, motor drivers for driving the conveyance motor 1709 and the carrier motor 5013, respectively. Note that the aforementioned heat pulse (HEAT), data (SR), shift clock (SRCLK), RESET, and CLK signals are transferred from the control unit 1710 to the printhead IJH through the head driver 1705.

The operation of the above control structure will be described below. When a print signal is inputted to the interface 1700, the print signal is converted into print data between the gate array 1704 and the MPU 1701 for a printing operation. The motor drivers 1706 and 1707 are driven, and the printhead IJH is driven in accordance with the print data supplied to the head driver 1705, thus performing the printing operation.

The components according to the embodiments of the present invention can be incorporated into the above-described control structure of the ink-jet printer.

Figure 6:
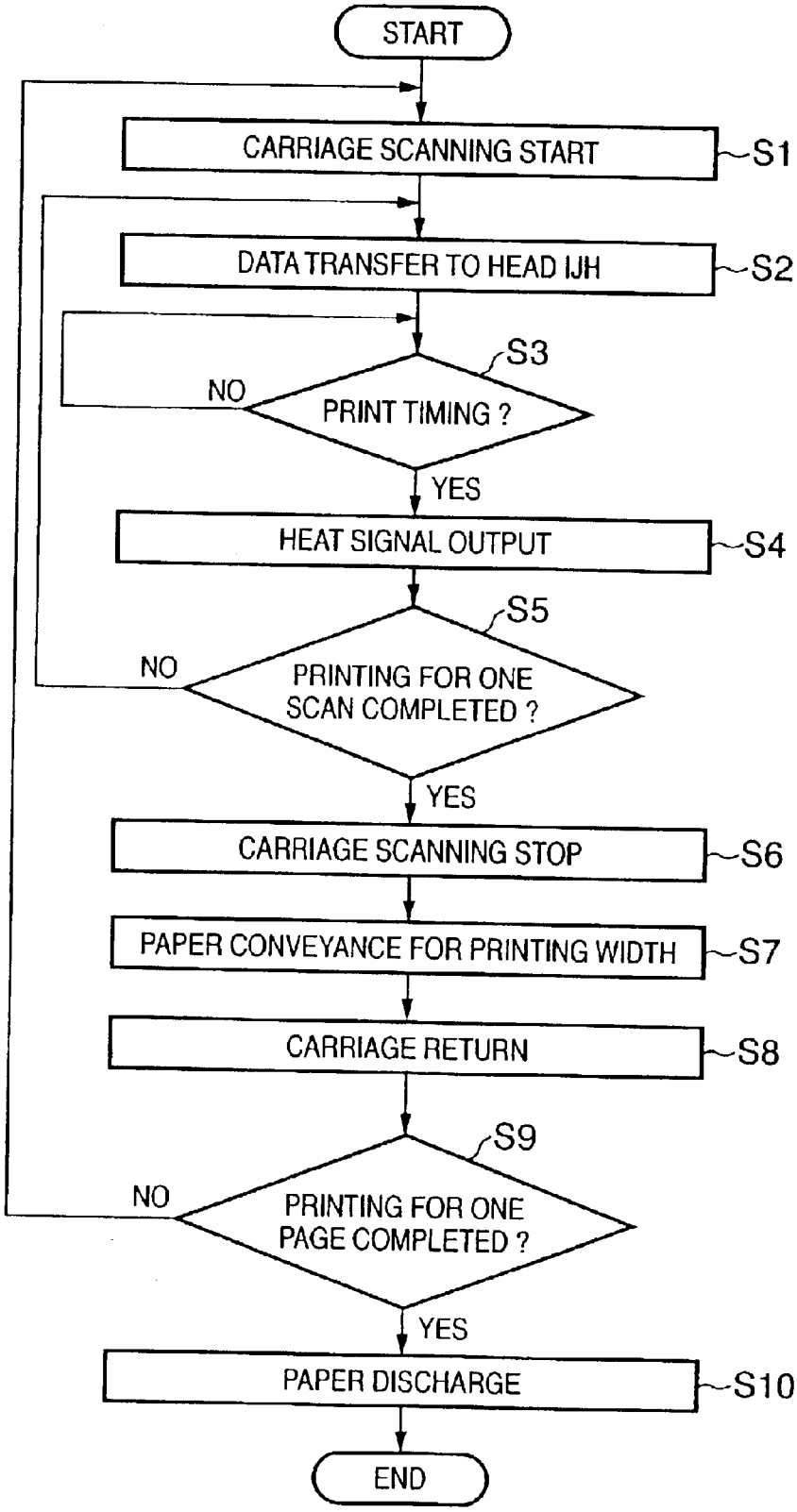
FIG. 6 is a flowchart describing a printing process performed by the ink-jet printing apparatus according to the embodiments of the present invention.

FIG. 6 is a flowchart describing a printing process performed by the ink-jet printing apparatus according to the embodiments of the present invention. The program executing the processing is stored in the ROM 1702, and is executed under the control of the MPU 1701. To facilitate the description of an operation, FIG. 6 also includes an operation realized by hardware, e.g., a gate array.

The processing starts when a print signal is received from an external apparatus (host computer) (not shown) through the interface 1700 and the amount of printing based on the received print signal reaches a predetermined amount, e.g., the amount of printing corresponding to one main-scan of the printhead IJH or one page. In step S1, scanning of the carriage HC is started by driving the carrier motor 5013. In step S2, print data to be printed at the next print timing and heating time-length data are serially transferred to the printhead IJH. At this stage, a number of shift clocks SCLK, corresponding to the number of bits of the data (8 clocks for 8 bits in the above example of FIG. 1), are supplied to the printhead IJH. In step S3, it is determined whether or not the printhead IJH has reached the printing position and the print timing has come. At print timing, the control proceeds to step S4, and the HEAT signal is outputted to the printhead IJH. As mentioned above, the flip-flop 10 is set during the time corresponding to the heating time-length, and the AND circuits 11 to 14 are opened in accordance with the print data during this time. The corresponding resistors (heaters) are driven in accordance with the corresponding print data, and printing is performed. In the foregoing manner, the printhead IJH performs printing for one column. In step S5, it is determined whether or not printing for one main-scan of the printhead IJH has been completed. If NO, the control returns to step S2 to transfer the next print data and heating time-length data. The above-described operations from steps S2 to S4, i.e., transferring print data and time-length data to the printhead IJH and outputting HEAT signals in synchronization with the data transfer, are performed by hardware such as the gate array circuit, because the processing by software is not fast enough.

When printing for one main-scan of the printhead IJH is completed, the control proceeds from step S5 to step S6. The driving of the carrier motor 5013 is halted to stop the scanning of the printhead IJH. In step S7, the conveyance motor 1709 is driven to convey the printing paper P for a distance corresponding to the printing width in the sub-scanning direction. In step S8, the printhead IJH is returned to the home position. In step S9, it is determined whether or not print processing for one page has been completed. If NO, the control returns to step S1 to start print processing for the next main-scan of the printhead. When print completion for one page is determined in step S9, the control proceeds to step S10 where the printed paper is discharged outside the apparatus, thereby ending the printing process for one page.

Although the above description has been provided on one-directional printing, in which printing is performed while the printhead IJH is scanned in one main direction, printing can also be achieved by bi-directional printing, in which printing is performed by reciprocal scanning of the printhead IJH.

Furthermore, in step S4, a plurality of printing elements (nozzles) of the printhead may simultaneously be driven for printing, or a plurality of printing elements (nozzles) may be divided into plural blocks and respective blocks may be driven for printing.

Figure 7:
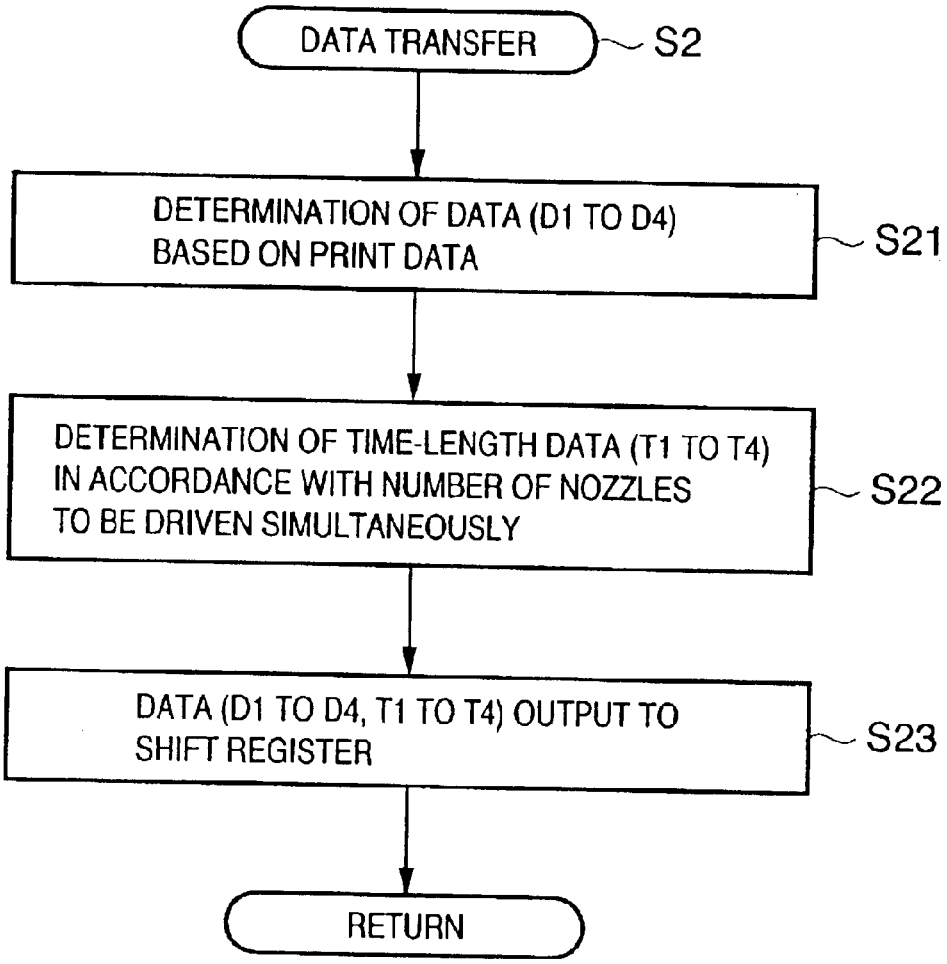
FIG. 7 is a flowchart describing the process of step S2 in FIG. 6 according to the first embodiment of the present invention.

FIG. 7 is a flowchart describing the process of step S2 in FIG. 6 according to the first embodiment of the present invention.

In step S21, data D1 to D4 are determined based on the print data to be actually printed. In step S22, the driving time-length data (T1 to T4) are determined in accordance with the number of nozzles to be driven simultaneously. In step S23, the data (D1 to D4 and T1 to T4) determined in steps S21 and S22 are transferred to the printhead IJH in synchronization with the shift clock SRCLK.

Next, the process of step S2 in FIG. 6 according to the second embodiment of the present invention is described with reference to the flowchart in FIG. 8.

Figure 8:
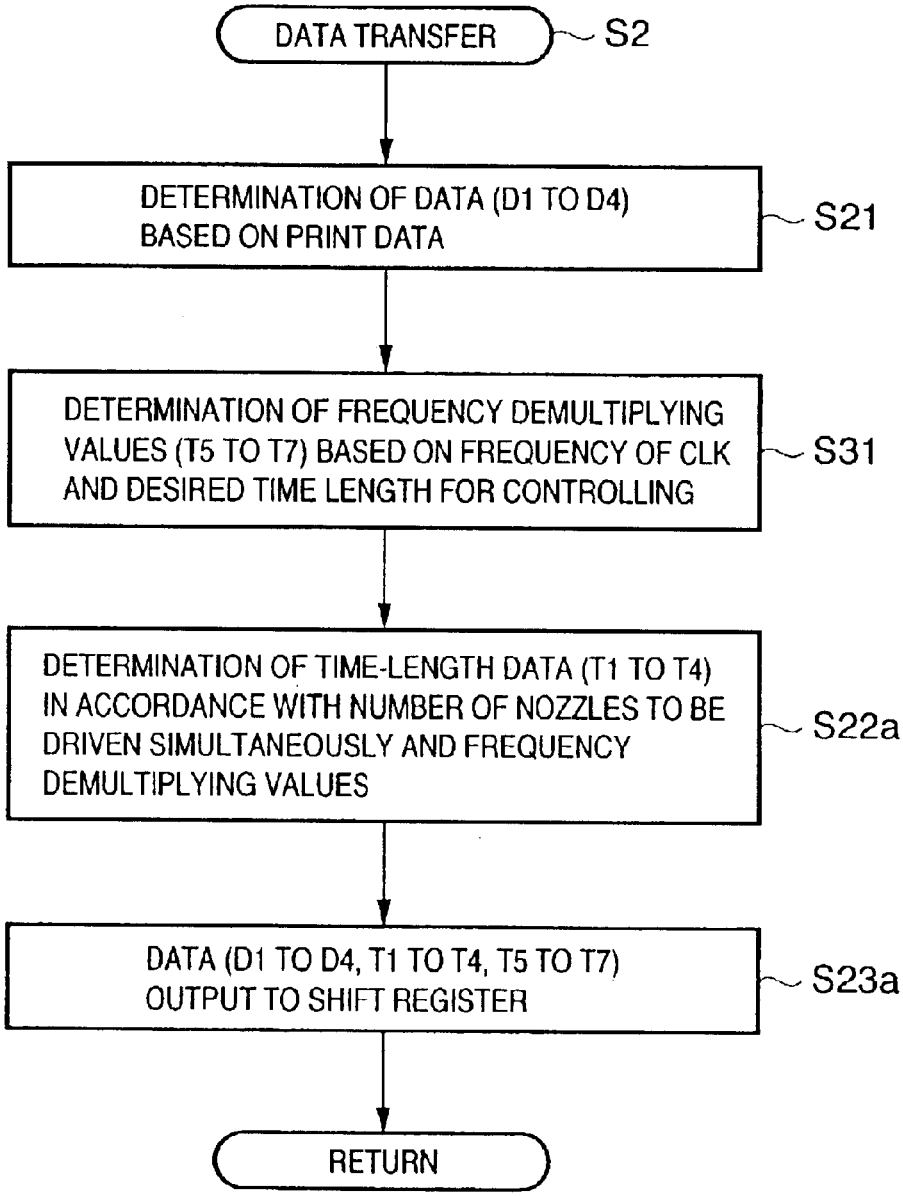
FIG. 8 is a flowchart describing the process of step S2 in FIG. 6 according to the second embodiment of the present invention.

FIG. 8 is a flowchart describing the process of step S2 in FIG. 6 according to the second embodiment of the present invention.

In step S21, data D1 to D4 are determined based on the print data to be actually printed, as similar to FIG. 7. In step S31, frequency de-multiplying values. (T5 to T7), for demultiplying the clock CLK by the frequency de-multiplier circuit 9, are determined based on a frequency of the CLK and a desired time length for controlling. In step S22*a*, the time-length data (T1 to T4) are determined in accordance with the number of nozzles to be driven simultaneously and the frequency de-multiplying values obtained in step S31. In step S23*a*, the data (D1 to D4, T1 to T4, and T5 to T7) determined in steps S21, S22*a*, and S23*a* are transferred to the printhead IJH in synchronization with the shift clock SRCLK.

The circuit, which performs data transfer of the heating time-length as a digital value, restoration of the heating time-length and heating control, operates in the foregoing manner.

In the above-described embodiments, the heating time-length data is restored from a digital value to actual time data in the internal unit of the printhead, but the data source of the heating time data is an external unit of the printhead IJH, that is, the gate array (GA) 1704 incorporated in the ink-jet printing apparatus.

In a case where the number of nozzles simultaneously driven is large, since the voltage applied to the heating elements drops, the heating time-length data is set long to compensate the voltage drop. On the contrary, in a case where the number of nozzles simultaneously driven is small, since a voltage drop does not occur, the heating time-length data is set short.

According to the circuit diagrams in FIGS. 1 and 3 of the above-described embodiments, up to 4 nozzles are simultaneously heated. However, the present invention is not limited to this number. By increasing the number of bits, it is possible to control the heating time-length with higher precision. Furthermore, in the circuit shown in FIG. 3 which includes the frequency de-multiplier function, more flexible control of the heating time-length according to circumstances can be achieved.

Furthermore, more efficient control of the heating time-length can be realized by providing a sensor which measures a temperature of the environment in the control unit of the printing apparatus, and by increasing/decreasing the heating time-length in accordance with the temperature detected by the sensor.

The present invention comprises means (e.g., an electrothermal transducer, laser beam generator, and the like) for generating heat energy as energy utilized upon execution of ink discharge, and adopts the method which causes a change in state of ink by the heat energy, among the ink-jet printing methods. According to this printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of a so-called on-demand type or continuous type system. Particularly, in the case of the on-demand type, the system is effective because, by applying at least one driving signal, which corresponds to printing information and causes a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions of the invention described in U.S. Pat. No. 4,313,124 which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region, is also included in the present invention. In addition, the present invention can be effectively applied to an arrangement based on Japanese Patent Application Laid-Open No. 59-123670 which discloses the arrangement using a slot common to a plurality of electrothermal transducers as a discharge portion of the electrothermal transducers, or Japanese Patent Application Laid-Open No. 59-138461 which discloses the arrangement having an opening for absorbing a pressure wave of heat energy in correspondence with a discharge portion.

Furthermore, as a full-line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, an exchangeable chip type printhead which can be electrically connected to the apparatus main unit and can receive ink from the apparatus main unit upon being mounted on the apparatus main unit, or a cartridge type printhead in which an ink tank is integrally arranged on the printhead itself, is applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independent of printing.

The object of the present invention can be achieved by providing a storage medium, storing program codes of software realizing the above-described functions of the embodiments, to a computer system or apparatus, reading the program codes, by a CPU or MPU of the computer system or apparatus, from the storage medium, then executing the program. In this case, the program codes read from the storage medium realize the functions according to the embodiments, and the storage medium storing the program codes constitutes the invention. The storage medium, such as a floppy disk, a hard disk, an optical disk, a magneto-optical disk, a CD-ROM, a CD-R, a magnetic tape, a non-volatile type memory card, and ROM, can be used for providing the program codes.

Furthermore, besides the aforesaid functions according to the above embodiments being realized by executing the program codes which are read by a computer, the present invention includes a case where an OS (operating system) or the like working on the computer performs a part of or the entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, a CPU or the like contained in the function expansion card or unit performs a part of or the entire processes in accordance with designations of the program codes and realizes functions of the above embodiments.

As has been set forth above, according to the foregoing embodiments describing a printhead for an inkjet printing apparatus and an ink-jet printer, it is possible to perform accurate control of a heating time-length by providing a circuit for controlling the heating time-length in an internal unit of the printhead.

Furthermore, it is possible to realize heating time control in the printhead without increasing the number of signal lines between the gate array and printhead.

Moreover, when collectively considering a balance of designed loads in the entire ink-jet printing apparatus, that is, a designed load of a printhead circuit and a designed load of a circuit other than the printhead, the most appropriate form of designed load can be achieved.

The present invention is not limited to the above embodiments and various changes and modifications can be made within the spirit and scope of the present invention. Therefore, to apprise the public of the scope of the present invention, the following claims are made.

What is claimed is:

1. A printhead having a plurality of heating elements and a driving circuit for electrifying and driving the heating elements, comprising:

a shift register adapted to serially input digital data supplied from an external unit, and retain the digital data;

counting means for counting a clock signal and outputting a counted value;

comparison means for comparing time-length data, included in the digital data, with the counted value outputted by said counting means, and outputting a match signal when a match is found; and driving signal generation means for enabling a driving signal in response to a driving start signal supplied from an external unit, and disenabling the driving signal in accordance with the match signal outputted based on the counted value counted by said counting means in response to the driving start signal, wherein the driving circuit electrifies and drives the heating elements based on the driving signal from said driving signal generation means and print data.

2. The printhead according to claim 1, wherein said counting means includes a counter which is reset by the driving start signal and performs counting in accordance with a clock signal supplied from the external unit.

3. The printhead according to claim 1, wherein the shift register is also used for inputting the print data.

4. The printhead according to claim 1, wherein said driving signal generation means includes a flip-flop circuit which is set by the driving start signal and reset by the match signal.

5. The printhead according to claim 1, further comprising frequency demultiplier means adapted to demultiply the clock, wherein said counting means performs counting in accordance with a clock signal demultiplied by said frequency demultiplier means.

6. The printhead according to claim 1, further comprising retention means adapted to retain the time-length data included in the digital data, wherein said comparison means compares an output of said retention means with the counted value of said counting means.

7. The printhead according to claim 1, wherein said printhead is an ink-jet printhead.

8. A printing apparatus comprising:

said printhead described in claim 1;

means for transferring print data to said printhead to be stored in the shift register;

means for transferring driving time-length data to said printhead to be stored in the shift register; and driving signal supplying means for supplying said printhead with the driving start signal in accordance with print timing.

9. A print control method of a printing apparatus including said printhead described in claim 1, comprising:

a step of transferring print data to the printhead and storing the data in the shift register;

a step of transferring driving time-length data to the printhead and storing the data in the shift register; and a step of supplying the printhead with the driving start signal in accordance with print timing.

10. A recording head for recording by driving heating elements in accordance with recording data, comprising:

a shift register adapted to serially receive the recording data and a signal for designating a time period of driving the heating elements via a signal line from a main body of an ink-jet apparatus; and recording means for recording using the recording data stored in said shift register and the signal for designating the time period of driving the heating elements.

11. The recording head according to claim 10, wherein the signal for designating the time period of driving the heating elements is a bit signal.

12. The recording head according to claim 10, wherein the head ejects ink by driving the heating elements.

* * * * *